US005685252A

United States Patent [19]

Prysner

[11] Patent Number: 5,685,252

[45] Date of Patent: Nov. 11, 1997

[54] DEVICE FOR REDUCING FLOW OF FLUID FROM A RUPTURED VESSEL

[75] Inventor: William J. Prysner, Gales Ferry, Conn.

[73] Assignee: The United States of America as represented by the Secretary of the Navy, Washington, D.C.

[21] Appl. No.: 411,232

[22] Filed: Mar. 27, 1995

[51] Int. Cl.[6] ..... B63B 43/16

[52] U.S. Cl. ..... 114/229

[58] Field of Search ..... 114/227–229

[56] References Cited

U.S. PATENT DOCUMENTS

| | | | |
|---|---|---|---|
| 770,078 | 9/1904 | Kruger | 114/229 |
| 1,307,040 | 6/1919 | Christensen | 114/229 |
| 2,127,871 | 8/1938 | Kozloff | 114/227 |
| 3,540,404 | 11/1970 | Modrey | 114/229 |

FOREIGN PATENT DOCUMENTS

| | | | |
|---|---|---|---|
| 1283347 | 12/1960 | France | 114/229 |

*Primary Examiner*—Sherman Basinger

*Attorney, Agent, or Firm*—Michael J. McGowan; Michael F. Oglo; Prithvi C. Lall

[57] ABSTRACT

There is presented a damage control device for reducing flow of fluid from a ruptured vessel. The device comprises a flexible blanket including chips of permanently magnetized metal embedded in a molded blanket of flexible oil-impermeable elastomeric material, such that the blanket as a whole comprises a flexible permanent magnet. Strength strands are provided with each strand having a portion embedded in the molded blanket and a terminal portion extending beyond a blanket edge. An attachment rings is secured to the terminal portion of each strand. Generally peripheral portions of the blanket are adapted to engage and magnetically fix to wall portions of the vessel surrounding a rupture therein. A generally central portion of the blanket is adapted to overlie the rupture.

4 Claims, 2 Drawing Sheets

DEVICE FOR REDUCING FLOW OF FLUID FROM A RUPTURED VESSEL

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

This invention relates to damage control devices for marine vessels and is directed more particularly to a device and method for reducing the flow of fluid from a ruptured ferrous hull of a marine vessel, when the rupture is located beneath the waterline.

(2) Description of the Prior Art

It is known to provide flexible patches for covering holes in vessels to prevent escape and/or entry of fluid through the hole. Many of the previous closure systems employ electromagnets used to hold oil impervious sheets against a ruptured wall of the vessel. U.S. Pat. No. 635,939, issued Oct. 31, 1899 to D. Mason discloses a canvas patch held in place by electromagnets. U.S. Pat. No. 5,009,179, issued Apr. 23, 1991 to Roscoe F. Johnson shows an oil-impervious flexible sheet held in place along top and side edges by electromagnets; the bottom edge being left open. In U.S. Pat. No. 5,036,786, issued Aug. 6, 1991 to Joseph Uri, there is presented a patch including a steel mesh blanket and a steel sheet, the patch having electromagnetic bars therein. Willard E. Williams, in U.S. Pat. No. 5,165,356, issued Nov. 24, 1992, provides a patch including a rigid plate member, a cushion layer, and a pliable sealing layer, held in place against a ruptured wall by electromagnets. In each of the above references, the patch is held in operative position by electromagnets in some manner attached to the periphery of the patch.

In U.S. Pat. No. 5,038,701, issued Aug. 13, 1991 to Floyd A. Riddell and U.S. Pat. No. 5,195,446, issued Mar. 23, 1993 to Floyd A. Riddell there is disclosed a flexible covering material for covering an opening in a hull of a ship. The covering material includes four layers of material, and between two of the layers are embedded an array of electromagnets.

In all of the above systems, a power source is required for providing energy for activating the electromagnets.

William T. Holt, in U.S. Pat. No. 5,009,180, issued Apr. 23, 1991, provides a patch system free of electromagnets, but utilizing a series of ropes or cables, sealing hoses, inflatable bladders, and the like, to set a sheet in place covering a rupture in the hull of a ship. The system requires on deck of the stricken ship a compressor and, preferably, a winch. Thus, though power is not required to activate electromagnets, power is required to activate the system by running of a compressor and, perhaps, a winch.

In some instances, there is no power on a stricken ship, and in remote areas no power readily available to an oil tank, tank car, or tower. Thus, there is a need for a device for covering openings in fluid-containing vessels, which device may be operated without electrical power. A need further exists for such a device as may be utilized without components in addition to the patch itself, such as cables, hoses, bladders, and the like. A still further need exists for such a device devoid of bulky and heavy electromagnets fixed to, or embedded in, the device.

SUMMARY OF THE INVENTION

An object of the invention is to provide a damage control device for reducing flow of fluid from a ruptured ferrous hull of a marine vessel, when the rupture is located beneath the waterline.

A further object of the invention is to provide such a device requiring no electrical power for utilization.

A still further object of the invention is to provide such a device having facility for use without additional components other than the device itself.

A still further object of the invention is to provide such a device devoid of heavy and bulky components, such as electromagnets in block or bar form.

With the above and other objects in view, as will hereinafter appear, a feature of the present invention is the provision of a damage control device for reducing flow of fluid from a ruptured ferrous hull of a marine vessel, the device comprising a flexible blanket including chips of permanently magnetized metal embedded in a sheet of flexible oil-impermeable material, such that the blanket, as a whole, comprises a flexible permanent magnet. Generally peripheral portions of the blanket are adapted to engage and magnetically fix to wall portions of the vessel surrounding a rupture therein, and a generally central portion of the blanket is adapted to overlie the rupture.

Strength strands are provided in the blanket, with each strand having a portion fixedly embedded in the blanket and a terminal portion extending beyond an edge of the blanket with an attachment ring secured thereto.

The above and other features of the invention, including various novel details of construction and combinations of parts, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawing in which is shown an illustrative embodiment of the invention, from which its novel features and advantages will be apparent.

In the drawings.

DESCRIPTION OF THE PREFERRED EMBODIMENT

Figure 1:
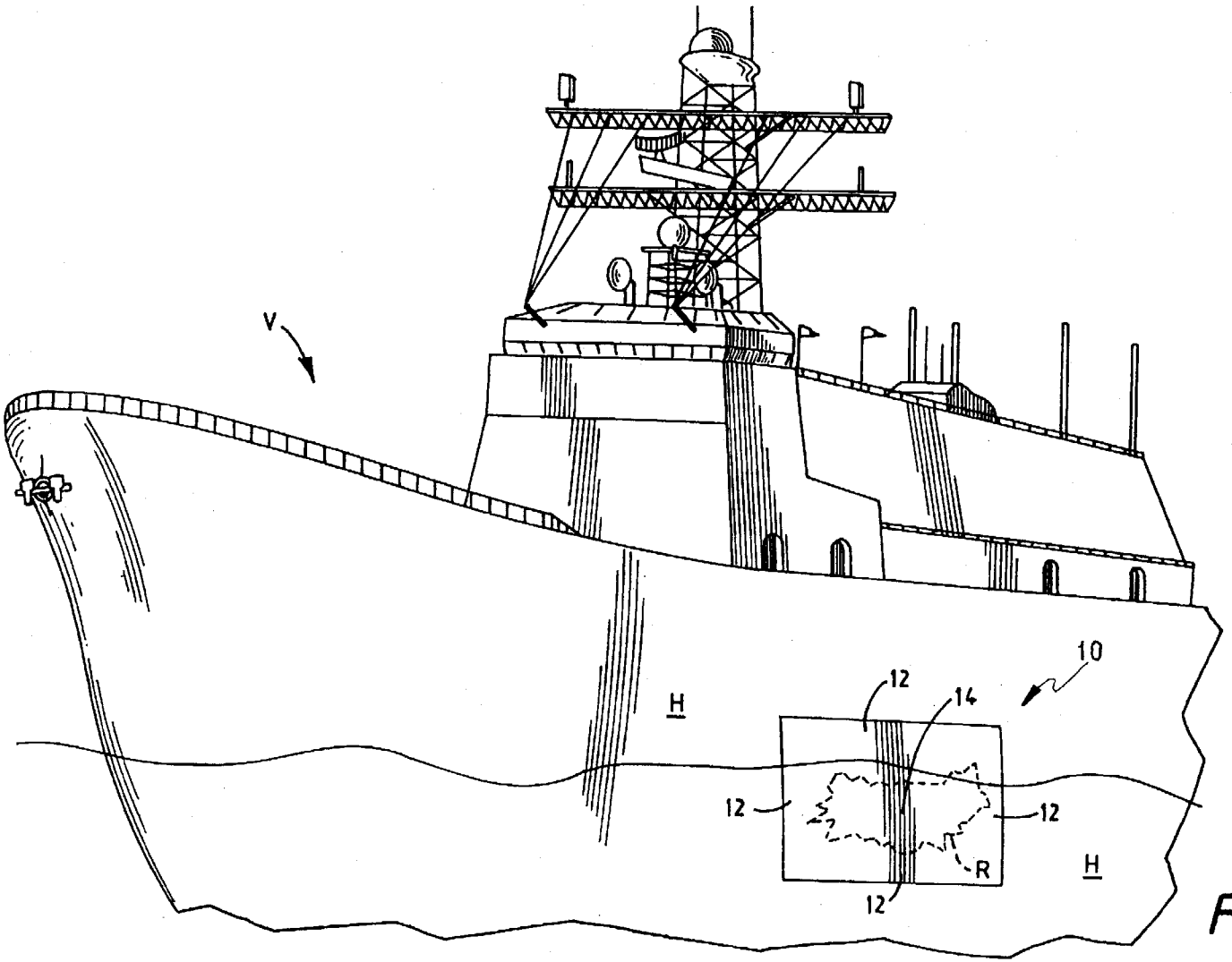
FIG. 1 is a perspective view of an illustrative blanket in on the ruptured hull of a ship.

Referring to FIG. 1, it will be seen that the illustrative damage control device comprises a flexible blanket 10. Blanket 10 comprises a flexible permanent magnet, including chips of permanently magnetized metal, such as iron-cobalt, embedded in a sheet of molded flexible oil-impermeable material, such as rubber or other elastomer material.

As shown in FIG. 1, generally peripheral portions 12 of blanket 10 are adapted to engage and magnetically fix to steel plate hull portions H of a vessel V surrounding a rupture R therein. A generally central portion 14 of blanket 10 is adapted to overlie at least a portion of the rupture R.

Figure 2:
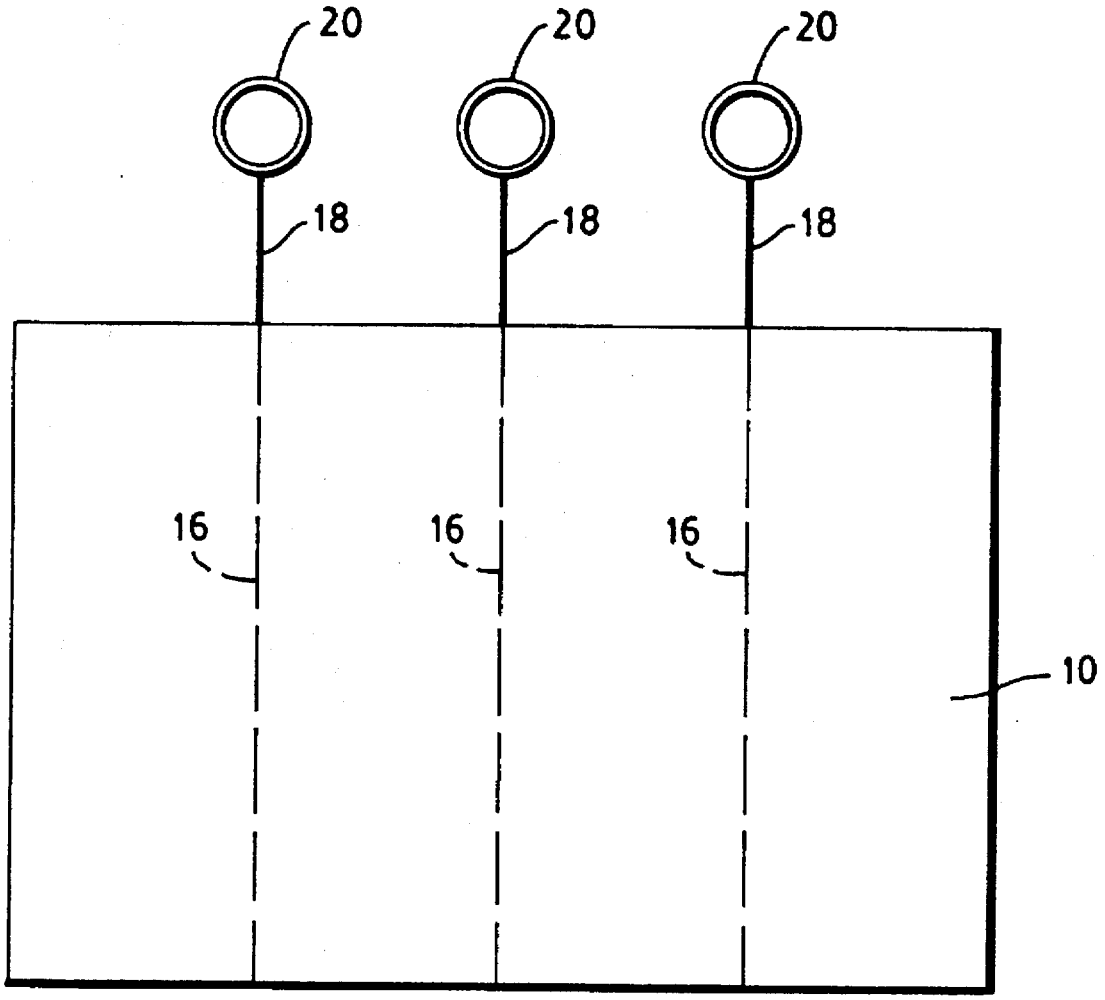
FIG. 2 is a front elevational view of an illustrative blanket showing a preferred means by which the blanket may be handled in application of the blanket to the hull of a ship.

Referring to FIG. 2, it will be seen that blanket 10 has formed therein high-strength strands 16, preferably of "Kevlar", or similar material. "Kevlar" is a polymeric compound produced and sold by E. I. Dupont Company. The word Kelvar is a trademark of that company. The strands 16 preferably include portions 18 extending beyond an edge of the blanket. Secured to free ends of strand portions 18 are rings 20, or other similar attachment means, by which the blanket may be lifted and moved into place.

In use, the blanket is positioned by helicopter, crane, divers with powered handling mechanisms, divers performing manual handling, or the like; such that a continuous strip all around peripheral portions 12 of blanket 10 will extend over the edge of rupture R with the total area and distribution of confronting surfaces of hull H and peripheral portions 12 providing sufficient magnetic adhesion forces to retain the blanket over the rupture. The peripheral portions 12 of blanket 10 are then brought into contact with external wall portions H of vessel V, whereupon peripheral portions 12 magnetically fix to the wall portions H of vessel V. The central portion 14 of the blanket 10 thereby overlies the rupture R, as shown in FIG. 1, or overlies a portion of the rupture if the rupture is large relative to the sizes of blankets available.

In selection of a proper size of blanket for a particular rupture, it is important to select a size of blanket which not only covers as much of the rupture as possible, but which is large enough such that the peripheral portions 12 thereof provide sufficient magnetic holding power to retain the blanket over the rupture, given the pressure exerted by fluid in the vessel seeking escape through the rupture.

There is thus provided a device and method for effectively reacting to oil cargo ruptures, and the like, to greatly diminish the flow of oil, or other fluid, from the vessel, thereby to diminish the usually severe consequences of fluid flow for extended periods of time. In use of the present invention, there is no need to electrically magnetize the blanket, and therefore no need for an electrical power source; and no separate components, such as bladders, vessel borne winches, or the like, are required to effect connection of the blanket to the ruptured surface.

It is to be understood that the present invention is by no means limited to the particular construction and method herein disclosed and shown in the drawing, but also comprises any modifications or equivalents within the scope of the claims. For example, while a ship is illustrated as a vessel to which the device herein is applied, it will be apparent that the device may be applied by the method herein to oil and other fluid storage vessels. Further, while the invention has been described principally with respect to impeding outflow of fluids from a marine vessel carrying the fluid, the invention has applicability in situations in which it is desired to prevent inflow of fluids, as in the case of a rupture in the hull of a freighter-type ship. The device has applicability with ruptures exposing fluid to the atmosphere, as well as ruptures under the waterline.

What is claimed is:

1. Damage control apparatus for reducing the flow of fluid from a ruptured vessel, said apparatus comprising:

a permanently magnetized flexible blanket made of a sheet of fluid impermeable material having chips of ferrous material embedded therein in at least peripheral portions thereof;

said sheet of fluid impermeable material further having embedded therein a portion of the span of each of at least two strength strands, said at least two strength strands having a terminal portion thereof extending beyond an edge of said blanket; and each terminal portion of said at least two strength strands having secured thereto an attachment means for receiving blanket positioning means.

2. Apparatus in accordance with claim 1 wherein said ferrous material is cobalt-iron.

3. Apparatus in accordance with claim 1 wherein:

said fluid impermeable material is an elastomeric material; and each said attachments means comprises a ring.

4. Damage control apparatus for reducing the flow of fluid from a ruptured vessel, said apparatus comprising:

a flexible blanket permanently magnetized in at least peripheral portions thereof, said blanket comprising a molded sheet of fluid impermeable elastomeric material;

said sheet of fluid impermeable elastomeric material having embedded therein a portion of a span of each of at least two strength strands, said at least two strength strands each having a terminal portion thereof extending outwardly beyond an edge of said blanket; and each terminal portion of said at least two strength strands having secured thereto an attachment means for receiving blanket positioning means.

* * * * *